United States Patent [19]

Adam

[11] 4,261,028

[45] Apr. 7, 1981

[54] LUMINAIRES

[76] Inventor: Marie H. H. Adam, Le Moulin, Lorey 54290 Bayon, France

[21] Appl. No.: 944,375

[22] Filed: Sep. 21, 1978

[30] Foreign Application Priority Data

Oct. 7, 1977 [FR] France ..... 77 30202

[51] Int. Cl.[3] ..... F21S 3/10; F21V 11/02

[52] U.S. Cl. ..... 362/279; 362/218; 362/224; 362/290; 362/292

[58] Field of Search ..... 362/282, 292, 325, 341–343, 362/346, 145, 279, 290, 291, 297, 366, 218, 224

[56] References Cited

U.S. PATENT DOCUMENTS

| | | | |
|---|---|---|---|
| 1,680,037 | 8/1928 | de Tartas | 362/61 |
| 1,773,245 | 8/1930 | Talbot | 362/291 |
| 2,732,483 | 1/1956 | Elmer | 362/297 X |
| 3,133,139 | 5/1964 | Beers | 350/283 |

FOREIGN PATENT DOCUMENTS

| | | | |
|---|---|---|---|
| 19004 | of 1929 | Australia | 362/291 |
| 188787 | 7/1888 | France | 362/341 |
| 79800 | 4/1962 | France | 362/290 |
| 1307312 | 7/1962 | France | 362/292 |
| 912557 | 3/1962 | United Kingdom | 362/346 |

*Primary Examiner*—B. Dobeck
*Assistant Examiner*—Shelley Wade
*Attorney, Agent, or Firm*—Michael J. Striker

[57] ABSTRACT

A street lighting luminaire comprising an elongated semi-cylindrical reflector of parabolic cross-section having opposite ends, and paralumens arranged to obtain a luminous beam whose divergent with respect to a plane normal to said axis varies from one to the other end of said reflector to obtain on the street a lightened area of rectangular cross-section.

6 Claims, 10 Drawing Figures

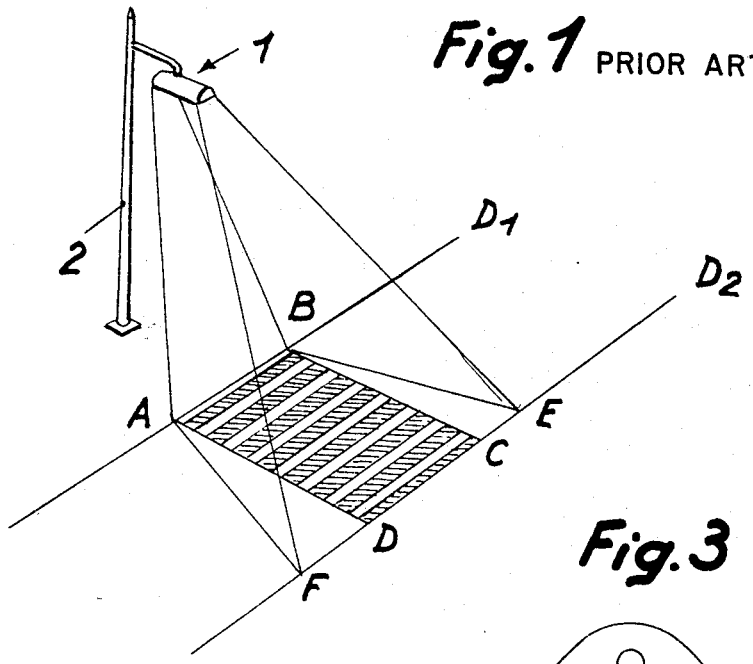
Fig. 1 PRIOR ART
Fig. 3
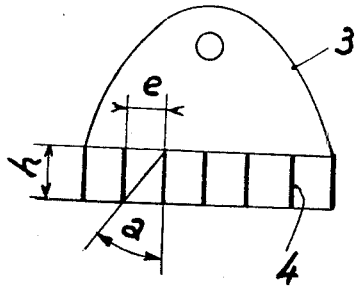
Fig. 2
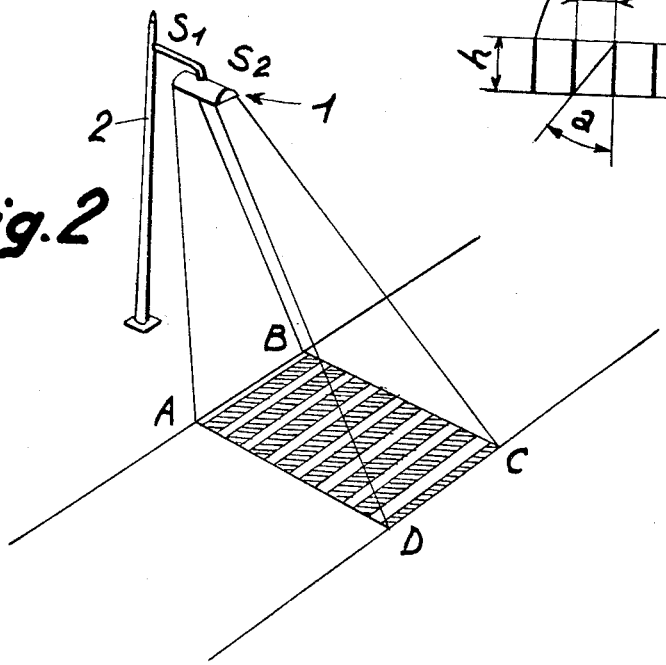

LUMINAIRES

The present invention relates to improvements in luminaires devised for illumination of rectangular surfaces such as pedestrian passages.

The actually utilized luminaires in illumination of passages for pedestrians are derived from usual public illuminating luminaires and do not differ therefrom otherwise than in having the luminous beam a little narrow and, if so designed, a luminous auxiliary signal on the body of the luminaire for making the presence of a pedestrian passage.

The experience has shown that these luminaires do not ensure a sufficient illumination and are short of providing a contrast in regard to the other portions of the highway and/or street even where these portions possess a just modest illumination.

Also, the trace area of the luminous beam on the ground does not have clear contours according to the direction perpendicular to the axis of the highway and/or street and it fades and dims which results in loss at the side of the illumination of the warning role.

The problem met here is therefore the need for a luminaire whose trace area of the beam on the ground possesses the limiting lines clear, clean and parallel.

Such a result could be achieved when use were made of a cylindrical and parabolic reflector disposed parallel with the ground and whose symmetry axis coincided with the vertical passing through the center of the rectangle delimiting the zone to be illuminated.

Unhappily, it is generally impossible to dispose such a reflector in this way, since the masts supporting the reflectors are situated at the side of the driveway to be illuminated.

Because of this, the trace area of the luminous beam on the ground adopts the form of a trapezoid.

The invention is concerned with a device permitting to obtain, starting from a luminous beam emitted by a cylindrical and parabolic reflector, a trace area on the ground being a luminous rectangle.

For limiting the divergence of the luminous beam reflected by a reflector, use already has been made of laminas (or paralumens) located parallel and situated under the reflector, which device is defined by the height h of the laminas and by the distance e separating the laminas, where the maximum dilatation of the beam in regard to the vertical is an angle of the tangent $a=e/h$.

According to the invention, there are used the paralumens disposed underneath the reflector in a manner such that the angle a changes from one extremity to the other of the reflector which is of cylindrical-parabolic type.

For achieving variation of the angle a use can be made of laminas whose height progressively changes from one extremity to the other or of laminas having parallel borders disposed obliquely in respect to the longitudinal axis of the reflector.

The invention will be better comprehended from the following description referring to the schematical drawings which are attached as exemplary only.

FIG. 1 is a perspective view demonstrating the trace area of the luminous beam obtained on the ground from a usual luminaire.

FIG. 2 is an analogous view similar to that of FIG. 1, showing the trace area obtained on the ground from the luminaire according to the invention.

FIG. 3 is a view of a transverse cross-section displaying the reflector according to the invention.

Referring to FIG. 1, it will be seen that the drive way road is delimited by straight lines $D_1$, $D_2$ and that the pedestrian cross-road passage is marked as a rectangle A B C D. In the practice, this disposition is very rare, because there is the endeavor to use the masts that already have been implanted.

Because the symmetry axis of the luminaire reflector does not coincide with the vertical axis passing through the center of the rectangle A B C D, the trace area of the luminous beam on the ground is delimited by the trapezoid A B E F which obliquely diverges from the sides BC and AD.

Now, the problem to be solved consists in utilizing a cylindrico-parabolic reflector for obtaining on the ground a trace area delimited by a quadrangle A B C D, as is shown in FIG. 2, in which constellation the dangerous zone of the road is clearly marked.

The consideration of FIG. 2 makes one to realize that for obtaining on the ground a rectangular trace area it is necessary that the angle $A\ S_1\ B$ be larger than the angle $D\ S_2\ C$ which is normal, because the side DC is spaced farther from the reflector than the side AB.

The solution of this problem resides in the use of an optical system permitting a progressive narrowing of the distension of the luminous beam from one side of the road to the other one.

Such a result is achieved when there are disposed under the reflector 3 paralumens, constituted by laminas 4 being sensibly vertical (FIG. 3).

The laminas 4 permit to limit the stretching of the beam at the angle a, whose value is given by the tangent $a=e/h$ in which expression h is the height of the laminas and e the distance separating them.

The distension of the beam must vary from the side AB to the side CD and therefore the tangent a ought to progressively change.

Figure 4:
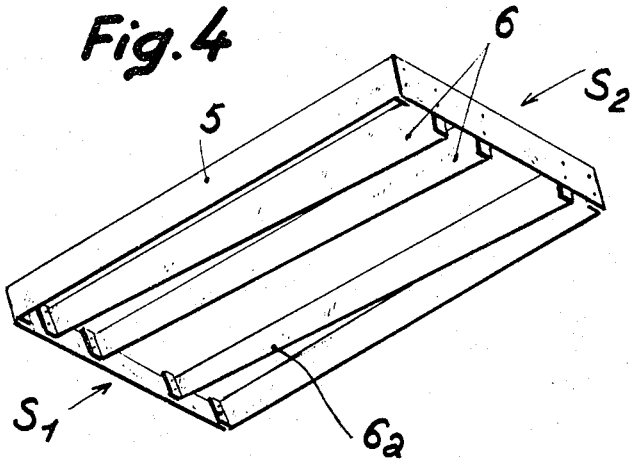
FIGS. 4, 5 and 6 are perspective views depicting the device with paralumens according to the invention.
Figure 7:
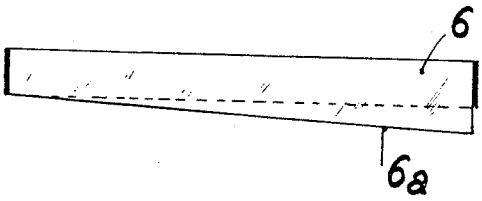
FIG. 7 is a longitudinal cross-section of the device of FIG. 4.

FIGS. 4 and 7 make apparent that the device is constituted by the frame 5 to be fixed under the reflector 3 and containing parallel lamelas 6, whose bottom edge 6*a* is oblique in relation to the upper one.

Figure 5:
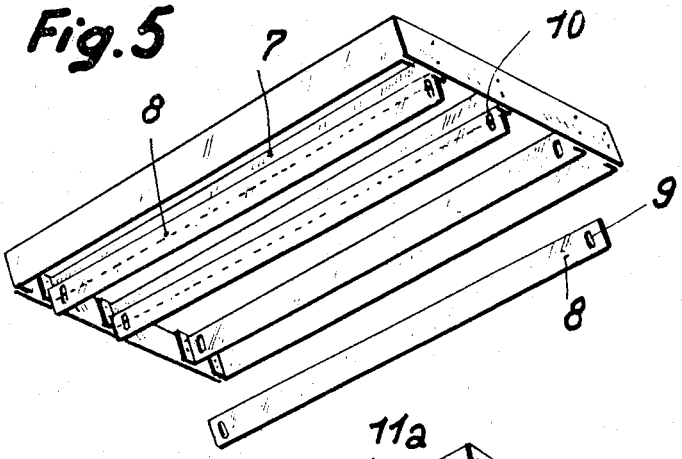
Figure 8:
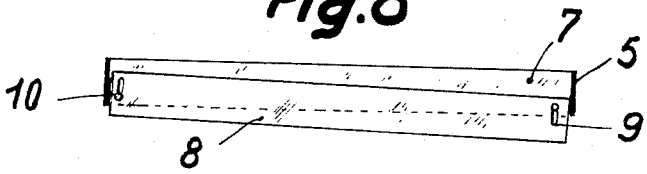
FIG. 8 is a longitudinal cross-section of the device of FIG. 5.

For avoiding the need to cut off the laminas trapezoidally, each lamina 6 may be formed by a combination of two bands 7 and 8, where the band 8 can be fixed to the band 7 for achieving that the longitudinal edges of the lamela formed by the combination of the two bands be not parallel. The regulation and fixation may be accomplished thanks to the holes 9 provided on the lamelas and the fixing screws 19 (FIGS. 5 and 8 ).

Figure 6:
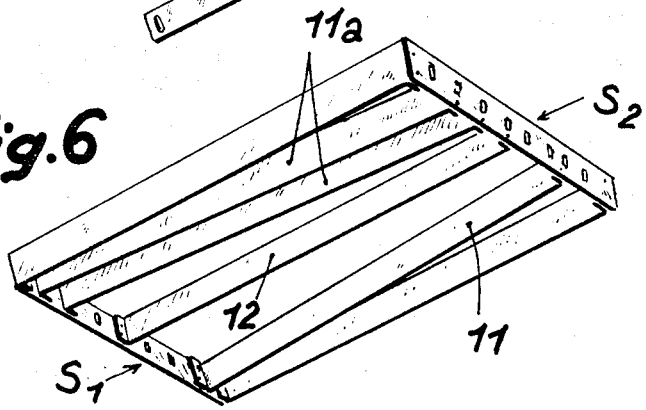
Figure 9:
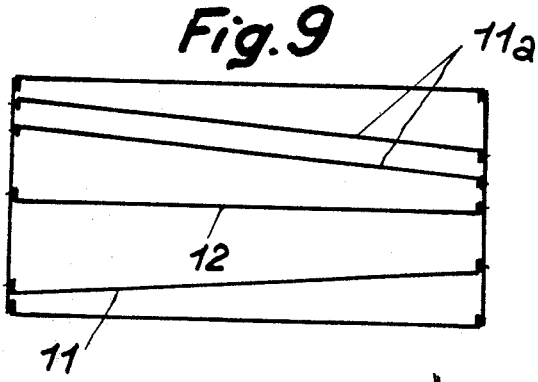
FIG. 9 is a view from above of the device of FIG. 6.

Another solution resides in the variation of the distance e. When attention is paid to the FIGS. 6 and 9, it becomes apparent that use is made of the lamelas 11 disposed obliquely in relation to the central lamina 12. The laminas 11 and 12 have a constant height.

Certain oblique lamelas may be parallel among them, such as those numbered 11*a*. In this case, even when the parameters e and h, are not modified, the wanted result is attained, the explanation whereof is the variation of a third parameter, i.e. of the distance of the lamelas in regard to the symmetry longitudinal plan of the system passing through the lamela 12 in the represented example.

In viewing the pair of lamelas 11*a* it will be seen that the extremity at $S_1$ is spaced farther from the lamela 12 than the extremity at $S_2$ and for this reason the luminous beam will narrower at this extremity $S_2$.

The regulation of the assembly of the embodiments described herein above, which may be necessary in view of the variations in the position of the mast 2, is carried out by adding or retiring the lamelas.

Now description will be made of the mode of fixation of the lamelas.

Figure 10:
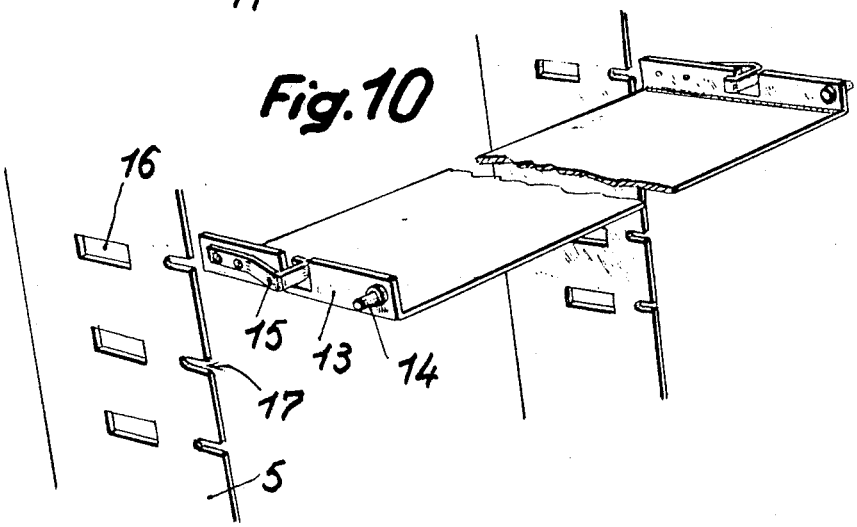
FIG. 10 is a perspective view showing the manner of fixation of the paralumens.

Each lamela is provided at its extremity with a tab 13 of quadrangular form carrying a finger 14 for positioning and a member 15 elastically defomable and susceptible to be introduced into a hole 16 in the frame 5. Notches 17 are provided on one of the edges of the frame 5 for receiving the fingers 14 (FIG. 10).

Quite clear, the present invention is not limited to the embodiments described and represented herein, but contrarily extends to all variants of form, material and dimension.

In this way, it is possible to utilize on the same reflector a combination of the means described herein above.

It is claimed:

1. A street lightening luminair comprising an elongated semi-cylindrical reflector of parabolic cross-section having opposite ends and an axis extending between said opposite ends; and paralumens arranged to obtain a luminous beam whose divergence with respect to a plane normal to said axis varies from one to the other end of said reflector to thus obtain on the street a lightened area of rectangular cross-section.

2. A luminaire as defined in claim 1, wherein said paralumens are constituted by a plurality of identical laminae extending parallel to said axis and normal to said plane and whose height uniformly changes from one to the other of said opposite ends.

3. A luminaire as defined in claim 2, wherein each of said laminae is constituted by two strips having parallel longitudinal edges and being fixed to one another in a manner so that said longitudinal edges of one of said strips includes an angle with those of the other strip.

4. A luminaire as defined in claim 1, wherein said paralumens are constituted by identical laminae having parallel edges, said laminae being disposed obliquely with respect to a longitudinal plane of symmetry of said reflector.

5. A luminaire as defined in claim 1, wherein said reflector has an open bottom end and including a frame connected to said open bottom end, said paralumens being mounted in said frame.

6. A luminaire as defined in claim 5, wherein said paralumens are constituted by a plurality of planar laminae each having end portions extending normal to the remainder of the respective laminae, and cooperating means on said frame and said end portions of said laminae for releasably attaching said laminae to said frame.

* * * * *